US006776283B1

(12) United States Patent
Drexler

(10) Patent No.: US 6,776,283 B1
(45) Date of Patent: Aug. 17, 2004

(54) PORTABLE DISPLAY AND STORAGE CASE

(76) Inventor: Fred Drexler, 3057 Kingston St., Port Charlotte, FL (US) 33952

( * ) Notice: Subject to any disclaimer, the term of this patent is extended or adjusted under 35 U.S.C. 154(b) by 124 days.

(21) Appl. No.: 10/067,690

(22) Filed: Feb. 4, 2002

(51) Int. Cl.[7] ..... B65D 85/66

(52) U.S. Cl. ..... 206/391; 206/408; 223/106; 211/85.5

(58) Field of Search ..... 206/391, 408, 206/397; 223/106, 107, 108; 211/85.5, 59.1

(56) References Cited

U.S. PATENT DOCUMENTS

| | | | | | |
|---|---|---|---|---|---|
| 242,607 | A | * | 6/1881 | Cutler | 206/391 |
| 243,479 | A | * | 6/1881 | Ware | 206/391 |
| 380,174 | A | * | 3/1888 | Bowles | 206/391 |
| 820,596 | A | | 5/1906 | Norwood | |
| 894,960 | A | | 8/1908 | Kovasic | |
| 1,421,099 | A | | 6/1922 | Reed | |
| 1,710,337 | A | | 4/1929 | Beach | |
| 2,226,693 | A | | 12/1940 | Bruno | |
| 2,380,117 | A | * | 7/1945 | Maldonado | 242/139 |
| 2,443,132 | A | | 6/1948 | Forsell | |
| 2,538,924 | A | | 1/1951 | Stearn | |
| 3,473,756 | A | * | 10/1969 | Jones | 242/137 |
| 4,036,418 | A | * | 7/1977 | Chlebda | 206/391 |
| 6,167,680 | B1 | | 1/2001 | Horn | |

* cited by examiner

*Primary Examiner*—Mickey Yu
*Assistant Examiner*—Troy Arnold
(74) *Attorney, Agent, or Firm*—Kilpatrick Stockton LLP

(57) ABSTRACT

A case for storing and displaying spools of thread is disclosed. The case comprises two trays preferably connected by a plurality of hinges. Inside each tray are elongate spines that extend longitudinally. Pins connected to the spine extend in a direction perpendicular to the spines. Spools are placed on the pins when stored. The pins are sized to provide a friction fit with the hollow inside portion of the spools. A tab is connected to each pin. When the tab is depressed, the pin is raised, allowing easy access to the desired spool. The pins are connected to the spine by a resilient U-shaped joint. The entire case is preferably made of transparent plastic material, such as polypropylene.

18 Claims, 5 Drawing Sheets

PORTABLE DISPLAY AND STORAGE CASE

THE FIELD OF THE INVENTION

The invention relates to a portable storage and display case and more specifically to a portable case for storing spools of thread or other similarly shaped items.

BACKGROUND OF THE INVENTION

Many crafts, hobbies or professions require organizational equipment to assist in storing and organizing the required tools or accessories. It is often beneficial to provide such organizational equipment in a form that is portable. Carrying cases such as briefcases, tool boxes, and camera bags have been developed to meet these needs. Such carrying cases are also currently being used for carrying fishing tackles, wrenches, or nuts and bolts. However, most such cases do not allow the user to visualize the contents without opening the box and do not provide a mechanism for quick and easy removal of the item from its stored location within the case. A carrying case is also needed for storing and organizing spools of thread, such as a thread case, which is useful to those who sew both recreationally and professionally.

Sewing, which is an art that is centuries old, became an essential skill in the 1800s. As times have changed, sewing has grown as a popular hobby for many. Sewing machines have evolved from large free standing units, typically displayed in the household much like any other furniture, to portable machines that can easily be stored between uses.

Both sewing professionals and recreational sewers typically use numerous spools of threads encompassing a wide variety of colors and types. The number of spools of differing colors used by a sewer can easily exceed 100. Additionally, sewers may also use spools containing thread of various types of thread composition and weight. It is therefore very helpful to keep the spools in an organized fashion, saving time and effort when changing thread colors and/or type during sewing. It is also important that the organizational tool be portable so that it can be easily stored, like the sewing machine, when not in use.

Many attempts have been made to provide a carrying case for spools of thread. These devices include sewing kits and thread boxes in many different configurations. Problems with these cases exist in that it may be difficult to quickly visualize the various colors and types of thread depending on the orientation of the case. Other problems occur if the spools are not easy to remove and quickly accessible when needed. Still other problems occur if the spools easily fall out of the case.

Thus a need exists in the art for a case which allows spools to be organized, stored securely and which allows easy and quick removal of spools for use in professional and recreational sewing.

SUMMARY OF THE INVENTION

The embodiments of the invention overcome the deficiencies in the art by providing a case for storing and displaying thread spools, which allow a user to easily organize the spools. The spools are clearly visible and easily accessible to the user, without falling out of the case.

The various embodiments of the invention provide a storage and display case for holding spools of thread. The case comprises two trays preferably connected by a plurality of hinges. The trays have four walls and an inner surface. A spine is attached to each tray and extends in a first direction. The spine extends from the top inner wall of each tray to the bottom inner wall. Holding pins are attached to the spine and extend in a direction that is generally perpendicular to the spine. The spools are placed on the holding pins for storage and display. A lifting tab is attached to each pin. When the lifting tab is depressed, the corresponding pin is raised, allowing easy access to the desired spool.

The pins are connected to the spine by a U-shaped joint. The U-shaped joint is resilient and retracts when the tab is released. The entire case may be made from a translucent plastic material.

It is therefore an object of the invention to provide a case for storage of thread spools.

It is another object of the invention to provide a case which allows users to organize thread spools.

It is another object of the invention to provide a case for storing thread spools which can be partially opened allowing the user to visualize the stored spools.

It is still another object of the invention to provide a case for thread spools that can be hung from home storage pegs.

It is another object of the invention to provide a case for displaying thread spools.

It is yet another object of the invention to provide a case for thread spools that can be hung from a display peg.

It is still another object of the invention to provide a case for storing thread spools that allows a user to easily access the desired spool.

It is yet another object of the invention to provide a case which allows users to organize a plurality of threads spools.

It is yet another object of the invention to provide a case for carrying thread spools that is easily portable.

Other objects, features, and advantages of the various embodiments of the invention will become apparent upon reading the following detailed description of the embodiments of the invention when taken in conjunction with the accompanying drawings and the appended claims.

DETAILED DESCRIPTION

Figure 1:
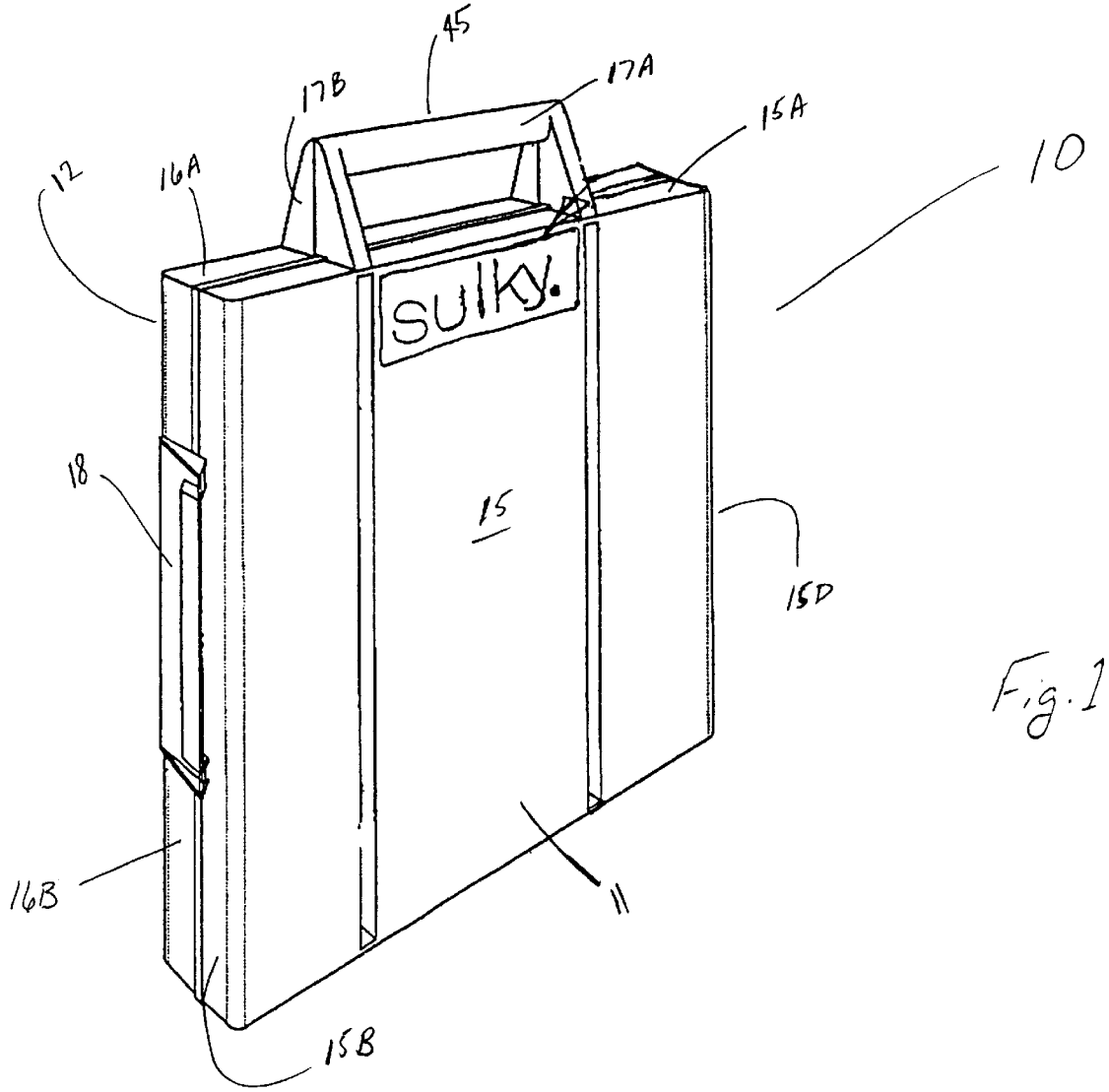
FIG. 1 is a perspective view of a case embodying the invention.

Referring now to the drawings, in which like numerals refer to like parts throughout the several views, FIG. 1 shows a storage and display case 10 embodying the invention. The case 10 may be constructed from any material such as plastic so long as it is durable, light, flexible and rigid enough to carry the weight of the stored material. This lightweight construction allows the case, weighing approximately two pounds when empty and approximately four pounds when filled with spools, to be easily portable. The case is also preferably constructed from transparent or translucent material.

Figure 2:
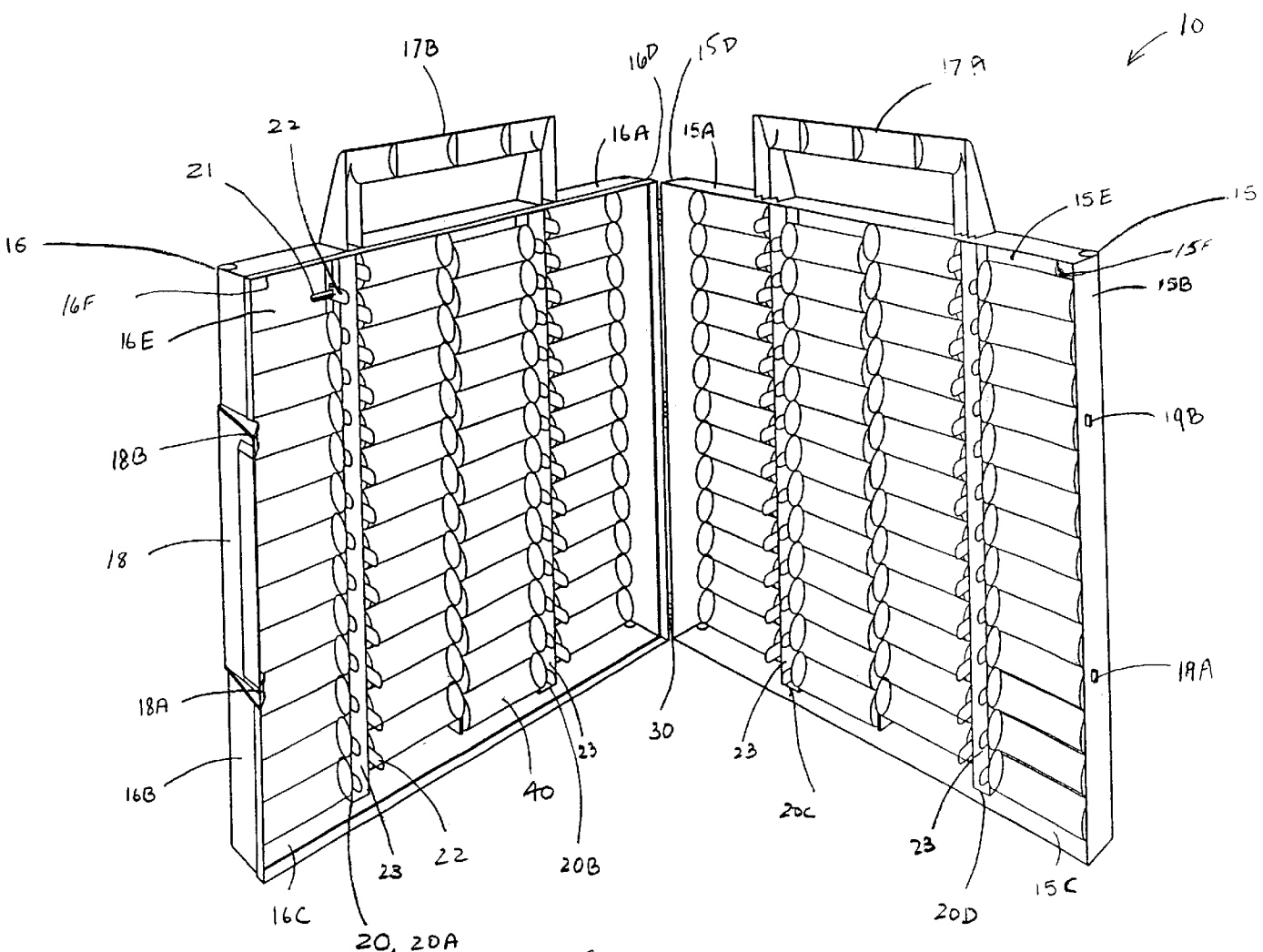
FIG. 2 is a perspective view of the case of FIG. 1, in an open configuration.

The case comprises trays 15 and 16 connected by three hinges 30. When the case is closed, as shown in FIG. 1, the back side of the tray 15 forms a first outer surface 11 and the back side of the tray 16 forms a second outer surface 12. The hinges 30 are located between a rear outer wall 15D of the tray 15 and a rear outer wall 16D of the tray 16. One hinge is located near the top of the case, a second hinge is located at approximately the midpoint of the rear outer walls 15D and 16D, and the third hinge is located near the bottom of the case. Any number of hinges may be suitable for attaching the tray 15 to tray 16 . A suitable hinge should allow a full range of motion so that the case 10, when opened, can remain opened at any angle between the two trays 15 and 16, as shown in FIG. 2. The hinges allow ease in opening and closing of the case.

Figure 5:
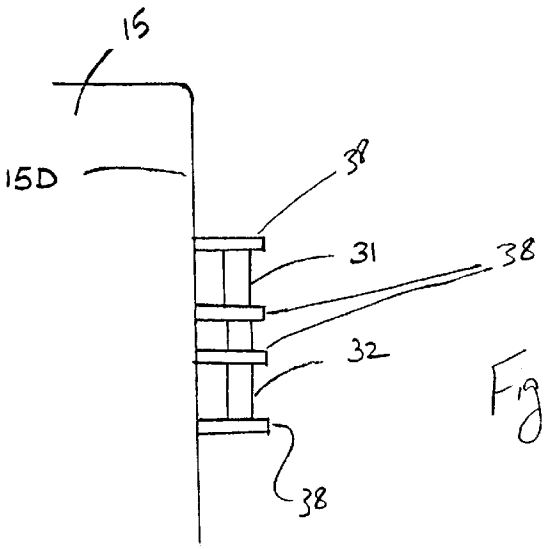
FIG. 5 is a view of an embodiment of the invention showing a portion of the hinge.
Figure 6:
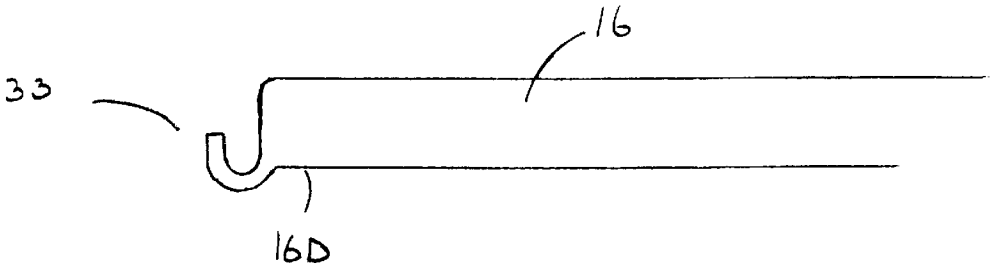
FIG. 6 is a view of an embodiment of the invention showing a portion of the hinge.

FIGS. 5 and 6 further illustrates one type of hinge, used in accordance with an embodiment of the invention to connect the two trays 15, 16. Any number of hinges may be suitable for attaching the tray 15 to the tray 16. However, a suitable hinge should allow a full range of motion so that the case 10 when opened can remain opened at any angle between the two trays 15 and 16. FIG. 5 further illustrates an exemplary friction fit-detachable hinge, created by mounting hinge pins 31, 32, located on the edge of wall 15D of the tray 15, with the bracket 33, located on the edge of wall 16D of the tray 16. The hinge pins are attached to the tray 15 by hinge pin support members 38. The hinge pins and bracket may be connected by a friction fit. It should be understood that a plurality of hinges may be used to connect the trays 15 and 16. Such a hinge is preferable because of the full range of movement it provides, secured fit, and the ease of assembly. Such a friction fit hinge will not require any additional tooling, fasteners, screws or other means of attachment to hold the hinge pins and the bracket together, thereby making it easy for one to detach the trays from each other. This may be helpful if the user wants to separate the two trays while sewing. The hinge pins 31, 32 may be mounted onto the wall 15D in any number of ways, but it is preferably molded when molding the entire tray 15. Likewise, the bracket 33 may be mounted onto the wall 16D in any number of ways, but is preferably molded when molding the entire tray 16.

A first handle portion 17A is mounted onto the top outer wall 15A of the tray 15. Likewise, a second handle portion 17B is mounted onto the top outer wall 16A of the tray 16. Preferably, the handle portions 17A and 17B are mounted, or molded, such that they are diametrically opposed to each other when the case 10 is closed forming a handle 45 extending upward from the top of the case for carrying the case. Whereas FIG. 1 shows exemplary handle portions, it should be understood that a variety of different types of handles may be provided to facilitate carrying the display and storage case 10. Handle portions 17A and 17B may also be connected to the top outer walls 15A and 16A using hinges (not shown) instead of being fixed. Alternatively, any number of known handles can be mounted solely on one of the trays 15 or 16. The handle portions 17A and 17B can be used to hang the case 10 from hooks, nails, or storage pegs in an open position so as to display the contents of the case to the user. Additionally, the case may be hung on store display pegs by the handle portions.

A bracket and pin latch assembly comprising of brackets 18A, 18B and pins 19A, 19B may be used to keep the case 10 closed. The brackets are attached to a front outer wall 16B of the tray 16. The pins extend outwardly from a front outer wall 15B of the tray 15. The brackets and pins are preferably made from the same plastic material as the entire case 10 and are aligned for engagement. When the case is closed, the brackets engage the pins and, with the application of slight pressure are friction fit to secure the case. The case can be opened by simply lifting the resilient plastic brackets and releasing the pins. It should be understood that any number of latch assemblies may be used for this purpose so long as they are durable, easy to use, and secure the case.

Figure 3:
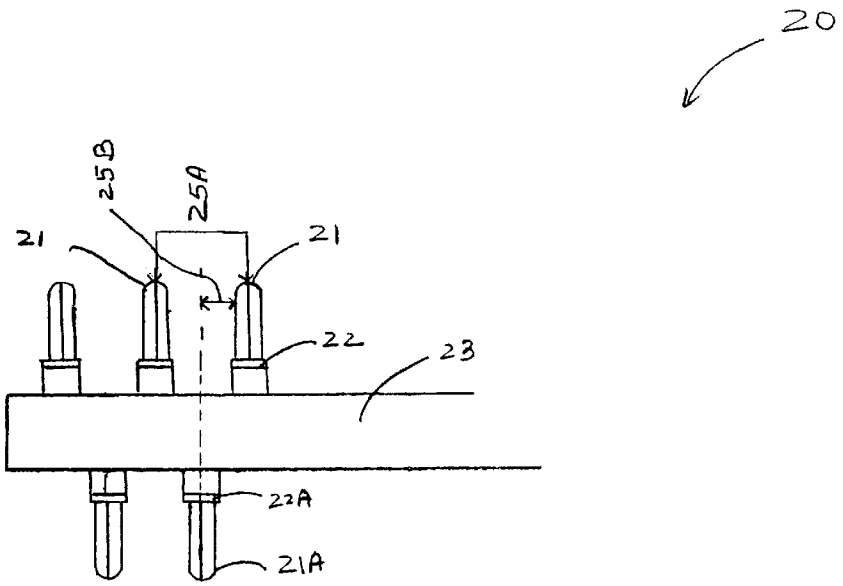
FIG. 3 is a top plan view of a spine located within the case of an embodiment of the invention.
Figure 4:
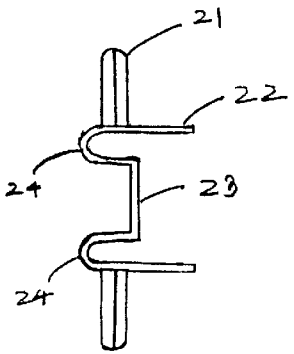
FIG. 4 is an end plan view of one end of a spine located within the case of an embodiment of the invention.

FIGS. 3 and 4 show a spool holding tree 20 of an embodiment of the invention located inside the case. The spool holding tree 20 comprises a plurality of spool holder pins 21, spool lifting tabs 22, and a spine 23. The spine 23 is an elongated member and extends longitudinally inside the case 10 from a top inner wall 16F of the tray 16 to a bottom inner wall 16C of the tray 16. It should be understood that similar spines 23 are located inside tray 15 as well. The spine is preferably molded from the same material as the case. The pins are connected to the spine by a U-shaped joint 24, and extend laterally away from the spine. Each pin has a corresponding spool lifting tab 22 which extends outwardly from the point where the pin 21 is connected to the U-shaped joint 24. The spool lifting tabs extend outwardly beyond the plane of the spine. The spine, U-shaped joints, pins, and spool lifting tabs are all preferably molded out of suitable plastic material such as polypropylene and are integrally connected. It should be understood that other suitable materials that are flexible and resilient may also be used.

Figure 7:
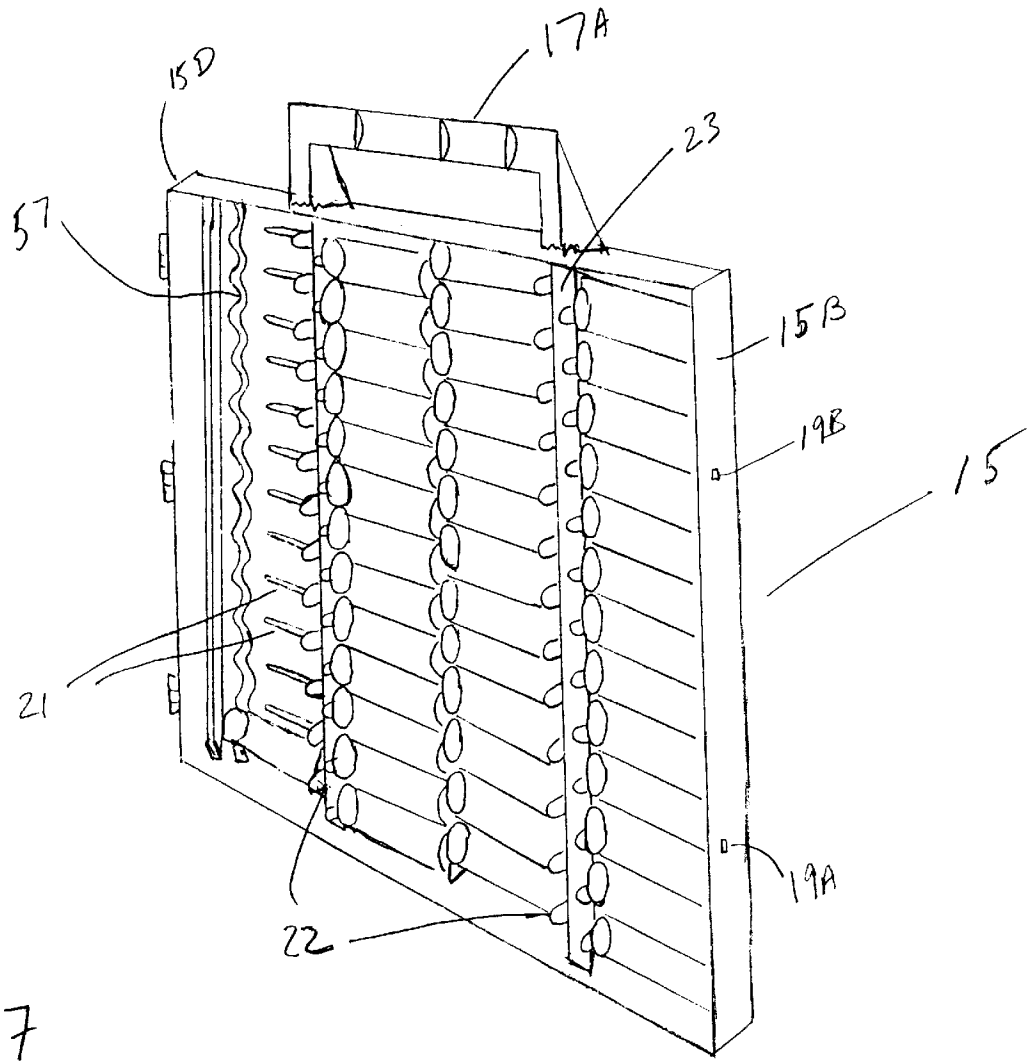
FIG. 7 is a perspective view of an embodiment of tray 15 of the invention.

FIG. 7 shows the interior of the case having a curved trough 57 opposite each pin. The troughs cradle the outer edge of the spools placed on each pin. The pins are oriented at a slight angle towards the interior surface 15E, 16E of the case. This provides downward pressure on spools placed on the pins, allowing the outer edge of the spools to be cradled by the troughs.

As shown in FIG. 2, each tray has two spines 23 extending longitudinally within the case. The pins extend laterally from the spine in both directions in a first position which is adjacent to the interior surfaces 15E, 16E of the trays 15, 16. The pins and corresponding spool removal tabs on either side of the spine are preferably not horizontally aligned to facilitate removal and replacement of the spools and accurate labeling as further described below.

A spool 40, in the form of a cylinder with a hollow center, can be mounted onto the pin 21 to hold the spool 40 securely in place during storage, transport, or display. The dimensions of the holding pins 21 are preferably approximately 1.25 inches in length and 0.25 inches in width such that they will ensure a snug fit between the spool 40 and each holding pin 21, with the spool exerting a slight compression force on the pin. The force should be sufficient to provide resistance between the inside of the spool 40 and the holding pin 21 preventing the spool 40 from inadvertently sliding off the pin 21, but not so great as to make it difficult to remove the spool 40 from the pin 21. The outer edge of the pin which comes in contact with the inner portion of the spool is slightly curved to conform to the curvature of the spool. This provides maximum contact between the spool and pin. It should be understood that the dimensions of the pins may vary depending on the size of the pin or other item to be stored in the case. The case can be opened in any manner, including hanging the open case on hooks or nails by the handle portion, without the spools falling out of the case. In the present embodiment, one spool may be mounted on each pin, allowing the case to hold a plurality of thread spools in a stored position. It should be understood that a plurality of spools may be stored on a single pin, depending on the length of the pin and length of the spools. The spools are stored in a flat position against the inner surfaces 15E, 16E of the trays. It may be preferable to arrange the spools according to the colors of the thread, types of thread or numerical sequence of the thread as further described.

Once the spools are mounted on the pins within the case, the spool lifting tabs 22 can be used to lift each individual spool 40 from its stored position when removing the desired spool 40 for use. The lifting is accomplished by applying pressure on the tab 22 corresponding to the desired spool, typically with one's thumb or finger, in a direction away from the stored spool and towards the spine. It should be understood that the spool lifting tab is preferably longer than the radius of the base of the thread spool cylinder. This allows the user to more easily depress the tab in order to lift the spool. The desired spool can then be removed from the pin by simply sliding the spool off the pin. The resiliency of the material used to form the U-shaped joint and the remainder of the tree causes the pin to automatically return to its initial position, adjacent the interior surfaces 15E, 16E, once the tab is released.

Each pin 21 and associated tab 22 assembly, as shown in FIG. 3 are attached to the spine 20 such that they are offset or staggered an appropriate distance 25B, preferably approximately ½ inches, from the center of the corresponding pin 21A and tab 22A assembly located on the opposite side of the spine 23. Such staggering facilitates the removal of each individual spool 40 from its stored position by allowing easy access to the spool lifting tab associated with the desired spool. The staggering of the tabs prevents users from inadvertently depressing the wrong tab, making the case easier to use. The staggering also allows users to associate labels with each thread spool. To aid in the symmetry beneficial for storage it is preferred that the distance 25B between opposing pin and tab assemblies be approximately half the distance 25A between two adjacent pin and tab assemblies. However, it should be understood that any offset distance can be used so long as the spools 40 may be lifted by depressing the tab 22 without interference from the tab 22A located on the opposite side of the spine 23.

The spine 23 of the spool tree 20 in FIGS. 3, 4 preferably should be wide enough to accommodate a marking strip that can be used to identify each individual spool by such characteristics as thread color, thread type, thread number or thickness. Spools of thread may be associated with a number for identification purposes. Each number corresponds to a color, weight, and type of thread. The marking strip, or labels placed on the spine may indicate the spool number next to each peg. The user may place the spool with corresponding number on the identified peg to organize the spools within the case.

Embodiments of the invention have been described with particular reference to the function of carrying spools of thread, however such a storage and display case can also be used to carry such items as photography film, spools of electrical wire, fishing tackles, jewelry, and any other item of similar size and shape.

While the invention has been described in detail with particular reference to preferred embodiments thereof, it will be understood that variations and modifications can be effected within the spirit and scope of the invention as described hereinbefore and as defined in the appended claims.

I claim:

1. A portable storage and display case for holding spools, comprising:

a first tray;

a second tray hingedly connected to the first tray;

at least one spine attached to each tray and extending in a first direction;

a plurality of holding pins attached to said spine for receiving spools, said pins extending in a direction generally perpendicular to said first direction, wherein said pins located on a first side of said spine are staggered from said pins located on the opposite side of said spine; and a lifting tab attached to each pin, said lifting tab lifting a single pin when depressed to allow access to a spool.

2. The case of claim 1, wherein said pins are sized to provide a pressure fit with spools.

3. The case of claim 1, wherein said tabs are longer than the radius of the base of a spool.

4. The case of claim 1, wherein each of said pins is attached to said spine by a U-shaped joint.

5. The case of claim 1, wherein the case is made from a translucent plastic material.

6. The case of claim 1, further comprising a handle portion attached to at least one of said trays.

7. A portable storage and display case for holding spools, comprising:

a first tray having four walls and an inner surface;

a second tray hingedly connected to said first tray, said second tray having four walls and an inner surface;

at least one spine attached to each tray and extending longitudinally from a top inner wall to a bottom inner wall;

a plurality of holding pins attached to said spine for receiving spools, said pins extending horizontally from each side of said spine, said pins located on a first side of said spine staggered with respect to said pins located on the opposite side of said spine; and a lifting tab attached to each pin, said lifting tab lifting a single pin when depressed to allow access to a spool.

8. The case of claim 7, wherein said pins are sized to provide a pressure fit with spools.

9. The case of claim 7, wherein each of said pins is attached to said spine by a U-shaped joint.

10. The case of claim 7, wherein the case is made from a translucent plastic material.

11. The case of claim 7, further comprising a handle portion attached to at least one of said trays.

12. A portable storage case for holding spools and other cylindrical objects, comprising:

a first tray having four walls and an inner surface;

a second tray hingedly connected to said first tray, said second tray having four walls and an inner surface;

at least one elongate member attached to each tray and extending in a first direction from a top inner wall of each tray to a bottom inner wall of each tray;

a plurality of holding pins attached to said elongate member for receiving spools, said pins extending in a direction generally perpendicular to said first direction; and a lifting tab attached to each pin, said lifting tab lifting a single pin when depressed to allow access to a spool.

13. The case of claim 12, wherein said pins are sized to provide a pressure fit with spools.

14. The case of claim 12, wherein said pins located on a first side of said elongate member are staggered from said pins located on the opposite side of said elongate member.

15. The case of claim 14, wherein said tabs are longer than the radius of the base of a spool.

16. The case of claim 14, wherein each of said pins is attached to said elongate member by a U-shaped joint.

17. The case of claim 12, wherein the case is made from a translucent plastic material.

18. The case of claim 12, further comprising a handle portion attached to each of said trays.

* * * * *